US006504514B1

(12) United States Patent
Toland et al.

(10) Patent No.: US 6,504,514 B1
(45) Date of Patent: Jan. 7, 2003

(54) DUAL-BAND EQUAL-BEAM REFLECTOR ANTENNA SYSTEM

(75) Inventors: Brent T. Toland, Manhattan Beach, CA (US); Youn H. Choung, Rolling Hills Estates, CA (US); Vrage Minassian, Burbank, CA (US); Ronald Y. Chan, Torrance, CA (US); James S. Hamada, Rancho Palos Verdes, CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/941,413

(22) Filed: Aug. 28, 2001

(51) Int. Cl.[7] ..... H01Q 13/00
(52) U.S. Cl. ..... 343/781 P; 343/786; 343/DIG. 2
(58) Field of Search ..... 343/781 P, 781 CA, 343/781 R, 786, DIG. 2; H01Q 13/00

(56) References Cited

U.S. PATENT DOCUMENTS 4,680,558 A * 7/1987 Ghosh et al. ..... 333/21 R
6,124,835 A 9/2000 Nguyen et al. ..... 343/881
6,163,304 A * 12/2000 Peebles et al. ..... 343/786
6,208,310 B1 * 3/2001 Suleiman et al. ..... 343/786

* cited by examiner

*Primary Examiner*—Hoanganh Le
(74) *Attorney, Agent, or Firm*—Harness, Dickey & Pierce, P.L.C.

(57) ABSTRACT

A satellite antenna system employing a dual-band feed horn and dual-band beam forming network. The feed horn provides a common aperture for both satellite uplink and downlink communications signal. The feed horn includes corrugations on an inside surface defining two sets of alternating channels having different depths to create circularly symmetric beams for the uplink and downlink signals. The antenna system includes at least one reflector, where the reflector shape, position, and the configuration of the feed horn, is determined so that the mainlobe of the lower frequency downlink feed signal illuminates the entire reflector, and the mainlobe of the higher frequency uplink feed signal illuminates an inner portion of the reflector. The first sidelobes of the higher frequency feed signal illuminate the outer portion of the reflector so that the uplink and downlink antenna signals have the same beamwidth, and thus cover the same cell size on the Earth.

22 Claims, 7 Drawing Sheets

DUAL-BAND EQUAL-BEAM REFLECTOR ANTENNA SYSTEM

BACKGROUND OF THE INVENTION

1. Field of the Invention

This invention relates generally to a dual-band equal-beam reflector antenna system and, more particularly, to a reflector antenna system for a satellite that employs a dual-band feed horn, including two different sizes of alternating corrugations, to create circularly symmetric beams at two different frequencies.

2. Discussion of the Related Art

Various communications systems, such as certain cellular telephone systems, cable television systems, internet systems, military communications systems, etc., make use of satellites orbiting the Earth to transfer signals. A satellite uplink communications signal is transmitted to the satellite from one or more ground stations, and is then retransmitted by the satellite to another satellite or to the Earth as a downlink communications signal to cover a desirable reception area depending on the particular use. The uplink and downlink signals are typically transmitted at different frequencies. For example, the uplink communications signal may be transmitted at 30 GHz and the downlink communications signal may be transmitted at 20 GHz.

The satellite is equipped with an antenna system including a configuration of antenna feeds that receive the uplink signals and transmit the downlink signals to the Earth. Typically, the antenna system includes one or more arrays of feed horns and one or more antenna reflectors for collecting and directing the signals. The uplink and downlink signals are typically circularly polarized so that the orientation of the reception antenna can be arbitrary relative to the incoming signal. To provide signal discrimination, one of the signals may be left hand circularly polarized (LHCP) and the other signal may be right hand circularly polarized (RHCP), where the signals rotate in opposite directions. Polarizers are employed in the antenna system to convert the circularly polarized signals to linearly polarized signals suitable for propagation through a waveguide with low signal losses, and vice versa.

For a satellite system, the coverage area on the Earth is broken into cells. The antenna coverage gain requirement for each cell then uniquely determines the reflector size. The combination of the reflector diameter and the reflector focal length will specify the feed locations and pointing angles. Further, each feed horn aperture must have a certain size for the frequency band of interest in order to provide a desirable antenna gain for that feed horn. Thus the feed horn size is much bigger than the cell size requires. Therefore, feed horns for the neighboring cells mechanically interface with each other when packaging as one feed array. In other words, because the feed horns must be a certain size to provide the desirable antenna gain, it is generally not possible to use the feed horns in the same array for contiguous cells on the Earth.

To provide the desirable antenna gain and still provide contiguous coverage on the Earth, it is therefore necessary to provide multiple antenna systems, each including a plurality of feed horns using the same reflectors, with each feed horn corresponding to a separate set of non-contiguous coverage areas, as designated, for example, by one of the letters A, B, C or D in FIG. 1. In one design, the satellite includes four separate antenna systems (A, B, C and D antennas in FIG. 2) for the uplink communications signals and another four separate antenna systems for the downlink communications signals. FIG. 2 illustrates this system. Because the uplink signals are typically at a higher frequency than the downlink signals, the size of the feed horn, and thus the size of the receive antenna system, is typically smaller than the size of the feed horns for the transmit arrays.

In order to reduce weight, conserve satellite real estate and decrease satellite production, integration and test costs, some satellite communications systems use the same antenna system and array of feed horns to receive the uplink signals and transmit the downlink signals. For example, if each antenna system on a satellite is a dual-band antenna system, then the number of antenna systems can be reduced from eight to four in the example being discussed herein. Combining satellite uplink signal reception and downlink signal transmission functions for a particular coverage area using a reflector antenna system requires specialized feed systems capable of supporting dual frequencies and providing dual polarization, and thus requires specialized feed system components. These specialized feed system components include signal orthomode couplers, such as four-arm turnstile junctions, known to those skilled in the art, in combination with each feed horn to provide signal combining and isolation to separate the uplink and downlink signals. Also, the downlink signal, transmitted at higher power (60–100 W) at the downlink bandwidths (18.3 GHz–20.2 GHz), requires low losses due to the cost/efficiency of generating the power and heat when losses are present.

One example of an antenna system providing both receive and transmit functions is referred in the industry as the MILSTAR dual band feed. The MILSTAR dual-band feed employs a co-axial design where concentric inner and outer conductive walls define an outer waveguide cavity and an inner waveguide cavity. The downlink signal is transmitted through the outer waveguide cavity and out of a tapered feed horn, and the uplink signal is received by the tapered feed horn and is directed through the inner waveguide cavity. A tapered dielectric is positioned at the aperture of the inner waveguide cavity to provide impedance matching between the feed horn and the inner waveguide cavity, and also launches the uplink signal into the inner waveguide cavity so that it is above the waveguide cut-off frequency. The inner surface of the feed horn is corrugated to provide a symmetrical pattern for both the uplink and downlink signals for equal E-plane and H-plane matching. The feed horn is tapered to provide an aperture suitable for illuminating the reflector associated with the antenna system.

Improvements can be made to those antenna systems that provide both transmit and receive functions. For example, because the uplink and downlink communications signals are at different frequencies, the cell coverage area for the uplink and downlink signals in the known dual-band antenna feeds have different beamwidths or cell size. Thus, the higher frequency uplink signal has a reduced coverage area than the lower frequency downlink signal when using a dual-band feed horn that affects antenna performance and uplink coverage capabilities.

What is needed is a dual-band antenna system for satellite communications where the uplink and downlink signals have the same beamwidths for optimal coverage capabilities. It is therefore an object of the present invention to provide such an antenna system.

SUMMARY OF THE INVENTION

In accordance with the teachings of the present invention, a satellite antenna system is disclosed that employs a dual-band feed horn and a dual-band beam forming network. The dual-band feed horn provides a common aperture for both a satellite uplink and a satellite downlink communications signal. The feed horn includes corrugations on its inside surface that define two sets of alternating channels having different depths to create circularly symmetric beams for the uplink and downlink signals. The antenna system includes at least one reflector, where the reflector size and position, and the configuration of the feed horn, is optimized so that the mainlobe of the lower frequency downlink feed signal illuminates the entire reflector, and the higher frequency uplink feed signal covers an inner portion of the reflector. The first sidelobes of the higher frequency feed signal illuminate the outer portion of the reflector so that the uplink and downlink antenna signals have the same beamwidth, and thus cover the same cell size on the Earth.

Additional objects, advantages and features of the present invention will become apparent from the following description and appended claims, taken in conjunction with the accompanying drawings.

DETAILED DESCRIPTION OF THE PREFERRED EMBODIMENTS

The following discussion of the preferred embodiments directed to a dual-band satellite antenna system employing a dual-band feed horn that provides equal beamwidths for an uplink and downlink communications systems is merely exemplary in nature, and is in no way intended to limit the invention or its applications or uses.

Figure 1:
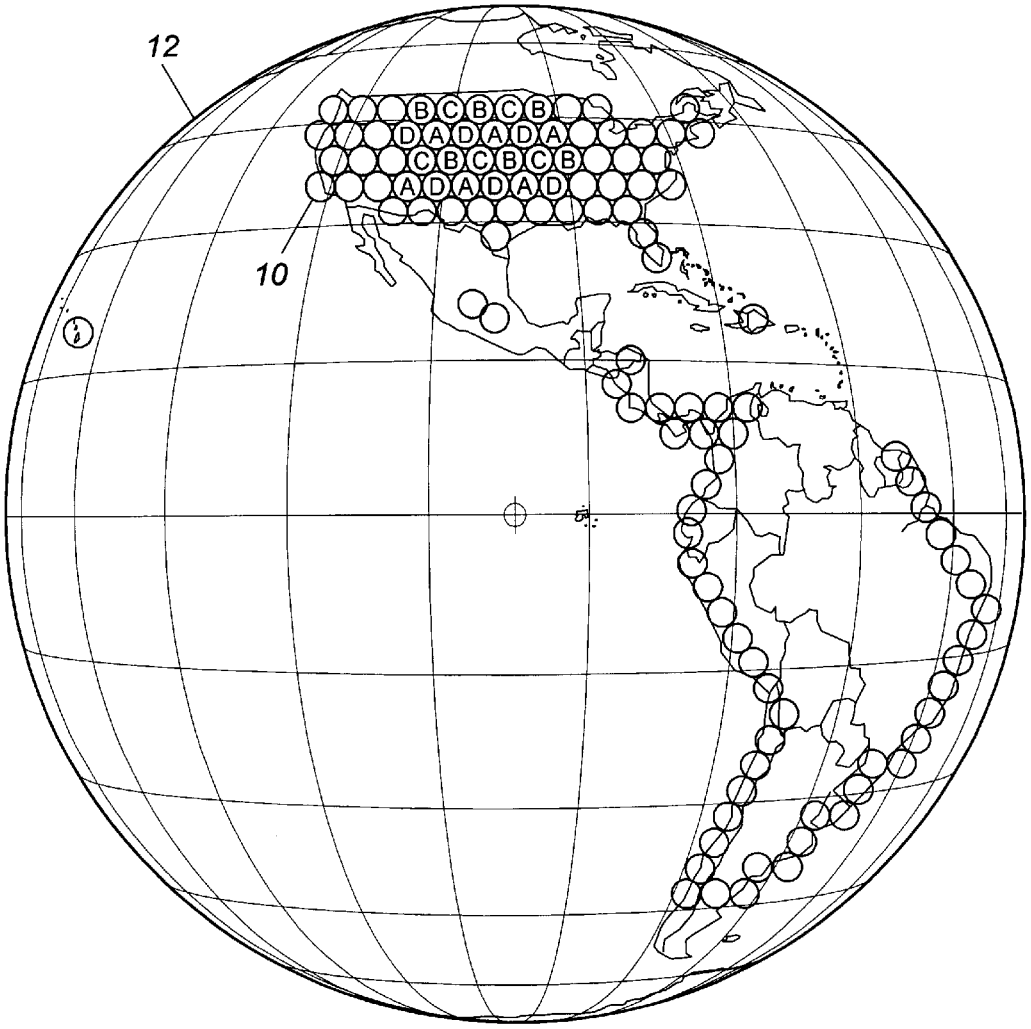
FIG. 1 is a plan view of uplink and downlink satellite coverage cells on the Earth.
Figure 2:
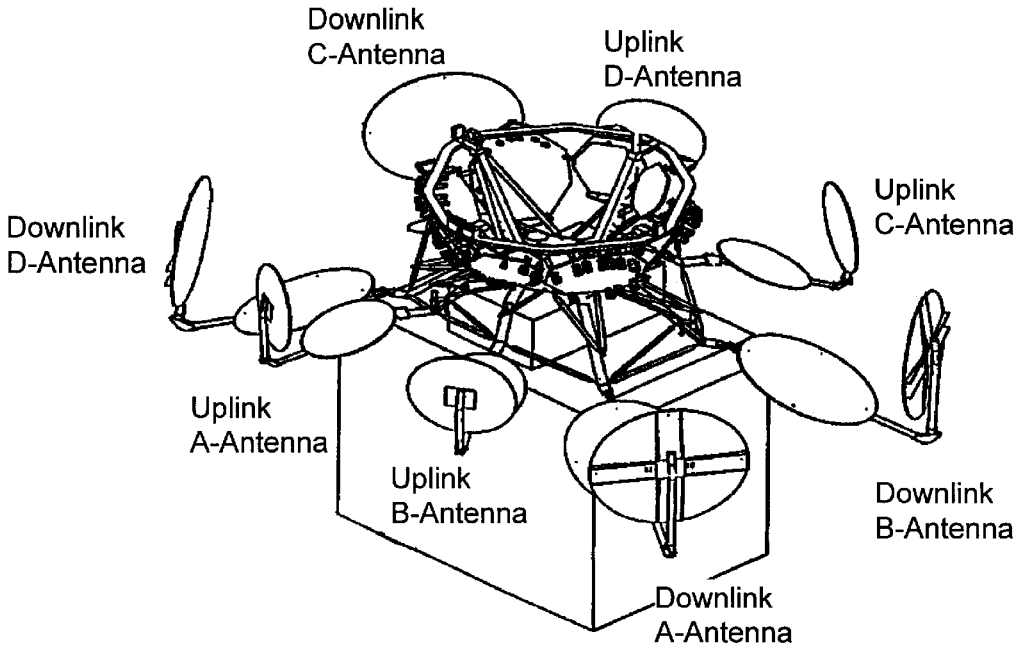
Figure 2 (Prior Art)
FIG. 2 is a perspective view of a satellite system known in the art and utilizing four separate uplink antenna systems and four separate downlink antenna systems.

FIG. 1 is a plan view of a plurality of coverage cells 10 on the Earth 12. In this example, there are four sets of coverage cells 10, labeled A–D. Each cell 10 is defined by a feed horn associated with an antenna system on a satellite. Each cell 10 labeled with: the same letter A–D is covered by a feed horn of a feed horn array in the same antenna system using the same reflectors or antenna aperture. As is apparent, no two cells 10 having the same letter A–D are contiguous, thus providing the necessary antenna gain for a particular application. Each cell 10 would provide signals in a particular sub-band within the uplink or downlink frequency band, where adjacent cells 10 use different sub-bands or the same band at different points in time. However, each antenna system would be able to provide any of the various sub-bands in the uplink or downlink frequency band. One earlier communication satellite system design included separate uplink and downlink antenna systems for each set of non-contiguous coverage areas A–D. As shown in FIG. 2, this approach required eight separate antenna systems for the example illustrated. According to the invention, each cell 10 provides coverage for both the transmit and receive functions, where the particular feed for that cell 10 is a dual-band feed tuned to both the uplink and downlink frequencies. Thus, each feed provides the same size beamwidth for both the uplink and downlink signals.

Figure 3:
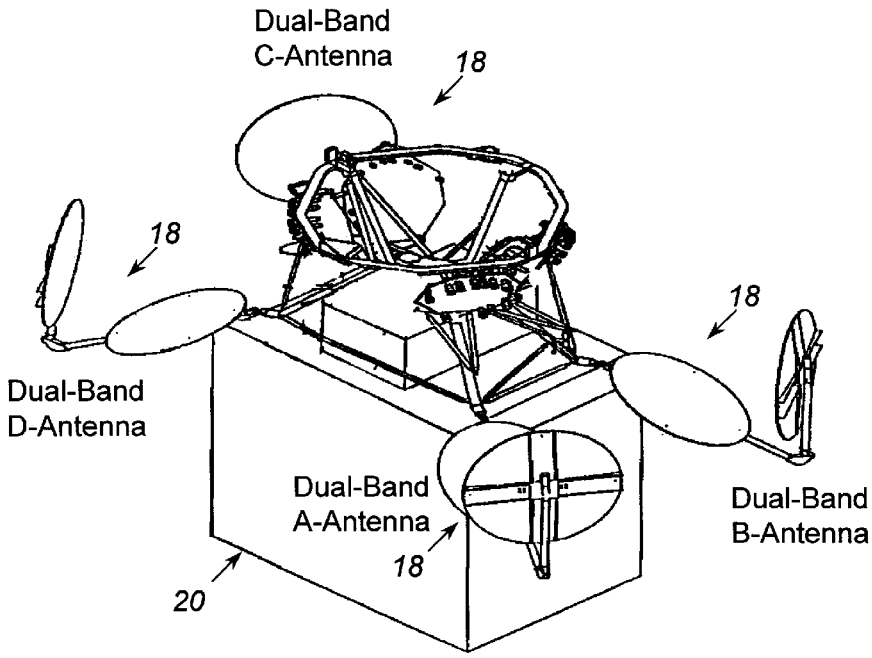
FIG. 3 is a perspective view of a satellite having four dual-band uplink and downlink antenna systems in accordance with an embodiment of the present invention.

FIG. 3 depicts a dual-band system in which the present invention may be implemented. Four antenna systems 18 are mounted to a satellite 20, and each of the antenna: systems performs both uplink signal reception and downlink signal transmission functions, as further described below.

Figure 4:
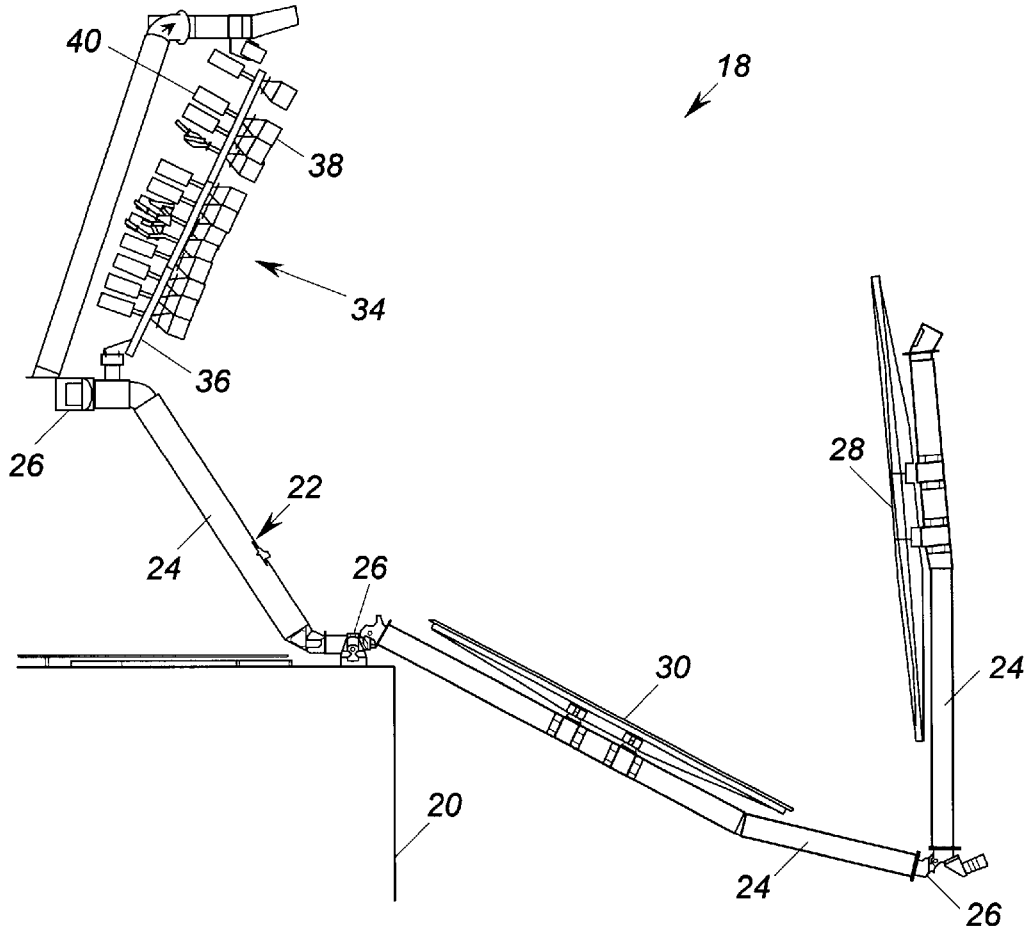
FIG. 4 is a plan view of a dual-band reflector antenna system for a satellite, according to an embodiment of the present invention.

FIG. 4 is a plan view of one of the antenna systems 18 mounted to the satellite 20. The antenna system 18 includes an articulated antenna arm assembly 22 including a plurality of antenna arms 24 joined together by hinge devices 26, as shown. The arms 24 are mounted together in a hinged type manner, so that the arms 24 fold together to conserve space within the spacecraft fairing for launch. The antenna system 18 is the type of antenna system disclosed in U.S. Pat. No. 6,124,835. The antenna systems 18 is shown by way of a non-limiting example, in that other antenna systems suitable for the purposes described herein can be used in accordance with the teachings of the present invention.

The antenna system 18 includes a first reflector 28 and a second reflector 30 mounted to adjacent arms 24, as shown. Additionally, a feed horn array 34 is mounted to a support platform 36, which is mounted to one of the arms 24, as shown. The feed array 34 includes a plurality of feed horns 38, where each feed horn 38 is coupled to a Beam Forming Network (BFN) 40. Each feed horn 38 defines one of the coverage cells 10 on the Earth 12. In the example being discussed herein, there would be four separate antenna systems 18 mounted to the satellite 20, where the feed horns 38 for a particular antenna system would be designated by one of the letters A–D for the coverage cells 10. Each beam forming network 40 is a dual-band beam forming network that processes downlink signals to be transmitted by the system 18 and receives uplink signals received by the antenna system 18. The reflectors 28 and 30 can be any type of reflector known in the art and suitable for the purposes described herein.

Figure 5:
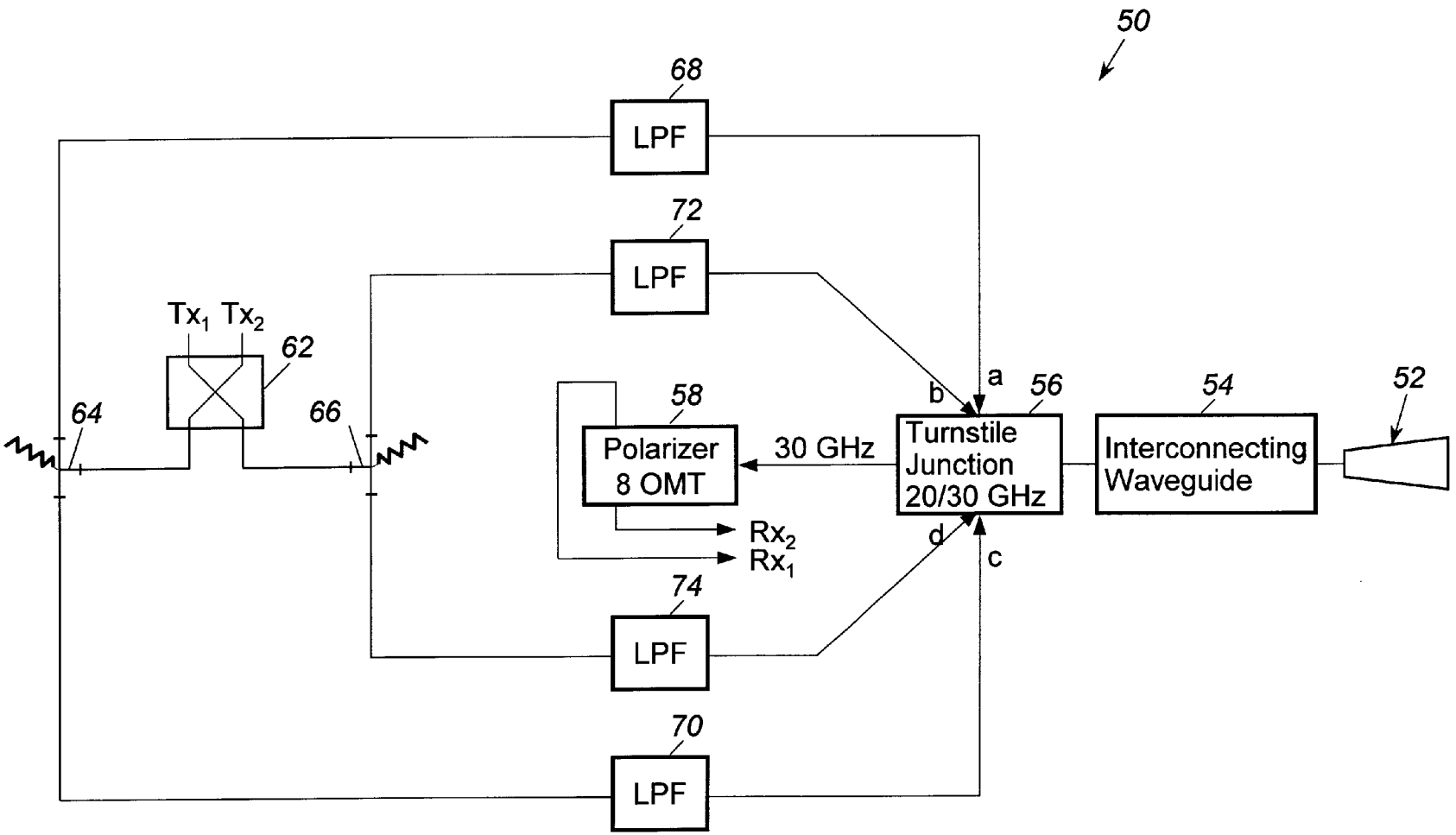
FIG. 5 is a schematic block diagram of a dual-band, dual-polarization beam forming networking, according to an embodiment of the present invention.

The BFNs 40 can be any known BFN suitable for the purposes described herein. FIG. 5 is a schematic block diagram of a beam forming network 50 that is known in the art and can be used as the BFN 40. Satellite uplink signals are received by a feed horn 52, representing one of the feed horns 38, and are impedance matched to an interconnecting waveguide 54 in the beam forming network 50. The uplink signals from the waveguide 54 are then sent to a turnstile junction 56 that separates and isolates the uplink signals at 30 GHz and the downlink signals at 20 GHz. The turnstile junction 56 is a waveguide device having co-axial chambers, where an inner chamber receives the uplink signals from the waveguide 54, and an outer chamber receives a plurality of downlink signals through symmetric waveguides around the outer chamber. The uplink signals received by the turnstile junction 56 are applied to a polarizer and orthomode transducer (OMT) 58. The polarizer and OMT 58 converts the circularly polarized uplink signals to linearly polarized signals oriented in two perpendicular directions identified here as $Rx_1$ and $Rx_2$. The polarizer and OMT 58 is a waveguide device that provides the function described herein, and can be any polarizer and OMT known to those skilled in the art suitable for the purposes described herein. The linearly polarized uplink signals $Rx_1$ and $Rx_2$ are then sent to a signal receiver (not shown) for signal processing and switching.

Downlink signals to be transmitted by the dual-band feed horn 52 are provided as two signals $Tx_1$ and $Tx_2$ to a 90° hybrid 62. The hybrid 62 provides two linearly polarized output signals that are 90° out of phase with each other. These signals are provided to a first magic T 64 and a second magic T 66 that separates each signal into two separate signals. The operation of 90° hybrids and magic Ts for this purpose are well known to those skilled in the art. The downlink signals from the magic T 64 are applied to low pass filters (LPF) 68 and 70, and the downlink signals from the magic T 66 are applied to LPFs 72 and 74, as shown. The downlink signals from the LPFs 70–74 are then sent to the downlink waveguides of the turnstile junction 56 to be combined therein and sent through the waveguide 54 to the feed horn 52, and exit as two orthogonal circularly polarized signals. The operation of a BFN 50 of the type discussed herein is well understood to those skilled in the art.

Figure 6:
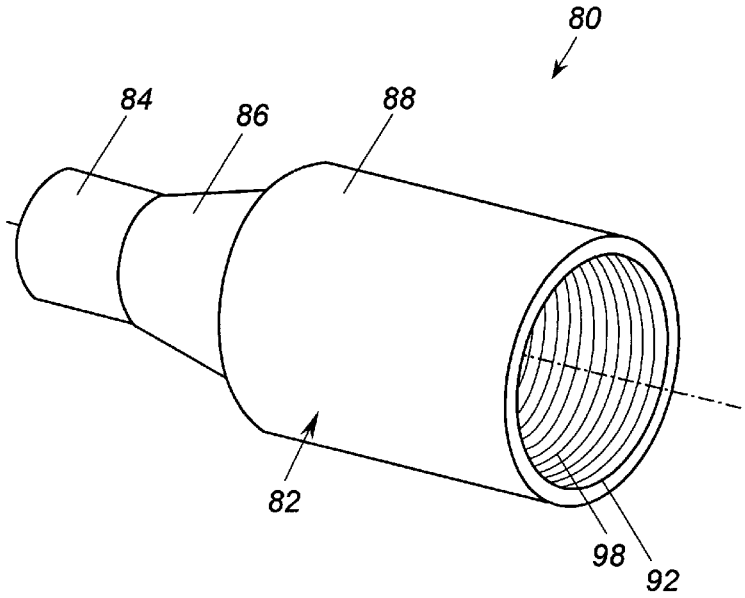
FIG. 6 is a perspective view of a dual-band feed horn for use in the dual-band antenna system of the invention.
Figure 7:
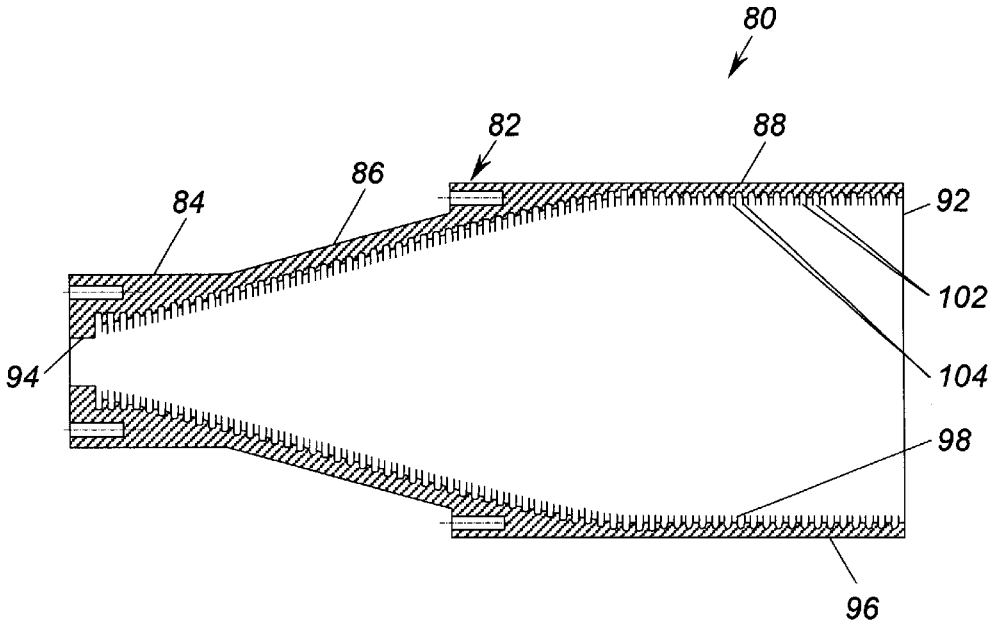
FIG. 7 is a cross-sectional view of the feed horn shown in FIG. 6.

FIG. 6 is a perspective view and FIG. 7 is a length-wise cross-sectional view of a dual-band feed horn 80 applicable to be used as the feed horns 38 and 52, according to the invention. The feed horn 80 is made of a conductive material, such as aluminum or copper, and includes an outer surface 82 defining a throat section 84, a flared section 86 and a cylindrical mouth section 88. An aperture or opening 92 of the mouth section 88 receives the uplink signals collected by the reflectors 28 and 30. The uplink signals propagate through the feed horn 80 and out of an opening 94 in the throat section 84. Likewise, downlink signals received from the beam forming network 40 enter the feed horn 80 through the opening 94, and expand through the tapered profile of the feed horn 80 to exit the feed horn 80 through the opening 92.

An internal surface 96 of the feed horn 80 includes a series of corrugations 98 that provide impedance matching and signal propagation profiles for a single mode of the uplink and downlink signals at the two frequency bands of interest. The corrugations 98 on the inner surface 96 define a first series of alternating channels 104 having one depth for the uplink signal, and a second series of alternating channels 102 having another depth for the downlink signal. In this example, the uplink signals have a higher frequency than the downlink signals, so the shallower channels 104 provide impedance matching for the uplink signals and the deeper channels 102 provide impedance matching for the downlink signals. A careful review of the channels 102 and 104 show that they alternate along the length of the feed horn 80, where the channels 102 and 104 actually get deeper from the opening 92 of the horn 80 towards the opening 94. A dual-band corrugated feed horn of this type having such corrugations is also known to those skilled in the art.

The corrugations 98, the length of the feed horn 80, the profile of the throat section 84, the flared section 86 and the mouth section 88, etc., would all be optimized for a particular frequency band for both the transmit and receive functions to provide the desired equal beamwidth signals of this invention. The diameter of the opening 92 would be set for the lower frequency signal, here the 20 GHz downlink signal. In one example, the feed horn 80 has a length of 9.230 inches; the opening 92 has an outer diameter of 3.875 inches and an inner diameter of 3.3945 inches; the length of the throat section 84 is 1.75 inches; the length of the flared section 86 is 2.5 inches; the angle of flare of the flared section 86 is 75°; the outer diameter of the throat section 84 is 1.875 inches; the outer diameter of the flared section 86 where it contacts the cylindrical 88 is 3.215 inches; and the diameter of the opening 94 is 0.540 inches. The depth of the channels 102 and 104 change from one end of the horn 80 to the other end.

According to the invention, the antenna system 18 is designed as a dual-band feed reflector antenna system that uses sidelobe illumination of the higher frequency signal to equalize the beamwidths of the lower frequency downlink signal radiation pattern and the higher frequency uplink signal antenna radiation pattern. In other words, the size and configuration of the feed horn 80, including the corrugations 98, is optimized so that the reflectors 28 and 30 are completely illuminated by the mainlobe of the lower frequency downlink signals and are partially illuminated by the mainlobe of the higher frequency uplink signals. Beamwidth equalization of the signals is provided by using the sidelobes of the higher frequency uplink signals. In this configuration, the reflectors 28 and 30 are illuminated by radiation from both the mainlobe and the first sidelobes of the uplink signals. For the application where the uplink signal is about 30 GHz and the downlink signal is about 20 GHz, the feed horn 80 is designed for a frequency ratio of 2/3. In this example, the feed has a −9 dB to −13 dB edge taper at the 20 GHz band, and at the same time, provides the mainlobe and the first sidelobe peaks as an edge taper at the 30 GHz band. The antenna system of the invention can also be optimized for other uplink and downlink frequencies and frequency ratios within the spirit of the present invention.

Figure 8A:
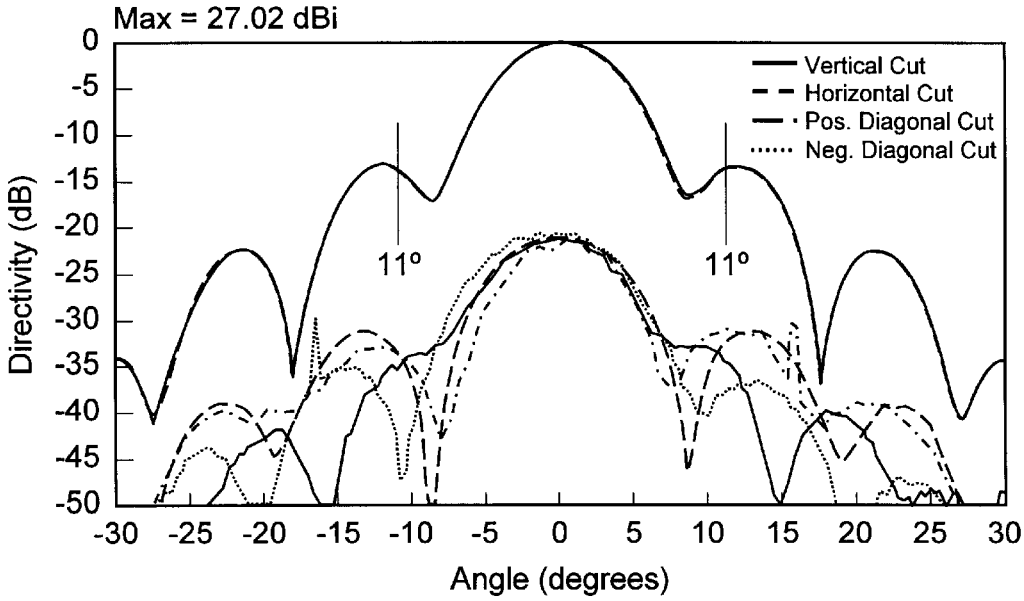
FIGS. 8(*a*) and 8(*b*) are primary pattern plots with beam directivity in dB on the vertical axis and angle in degrees on the horizontal axis for a dual-band feed operating at 29.5 GHz and at 19.7 GHz, respectively.
Figure 8B:
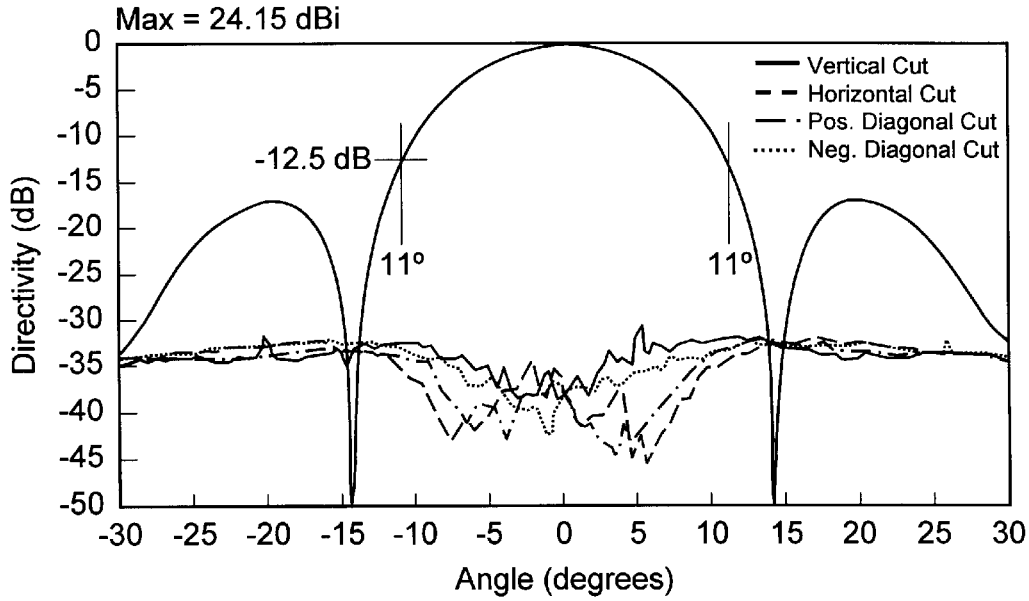

FIGS. 8(*a*) and 8(*b*) are primary pattern plots with beam directivity in dB on the vertical axis and angle in degrees on the horizontal axis. FIG. 8(*a*) shows the measured primary feed patterns for a dual-band feed of the invention at 29.5 GHz, and particularly the measured co-polarization (LHCP) and measured cross-polarization (RHCP) of a vertical cut, horizontal cut, positive diagonal cut and negative diagonal cut. Likewise, FIG. 8(*b*) shows the measured primary feed patterns for a dual-band feed of the invention at 19.7 GHz, and particularly the measured co-polarization (LHCP) and cross polarization (RHCP) of a vertical cut, horizontal cut, positive diagonal cut and negative diagonal cut.

Figure 9A:
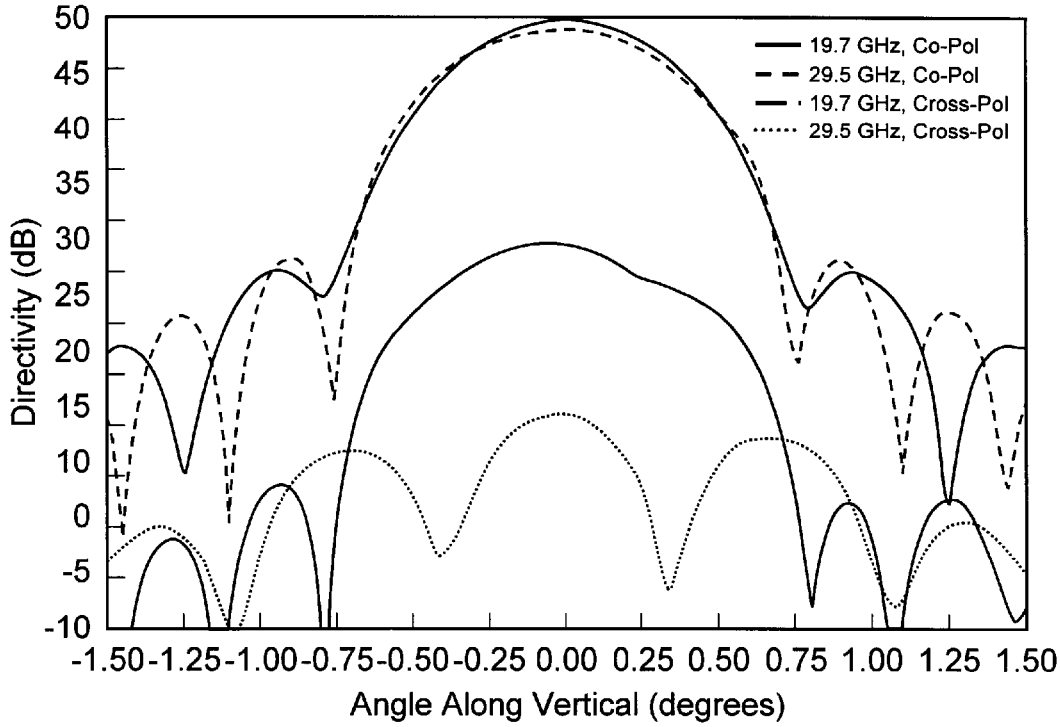
FIGS. 9(*a*) and 9(*b*) are graphs with directivity in dB on the vertical axis and angle in degrees on the horizontal axis for secondary pattern cuts of a dual-band feed horn feeding an offset parabolic reflector and normalized pattern cuts, respectively.
Figure 9B:
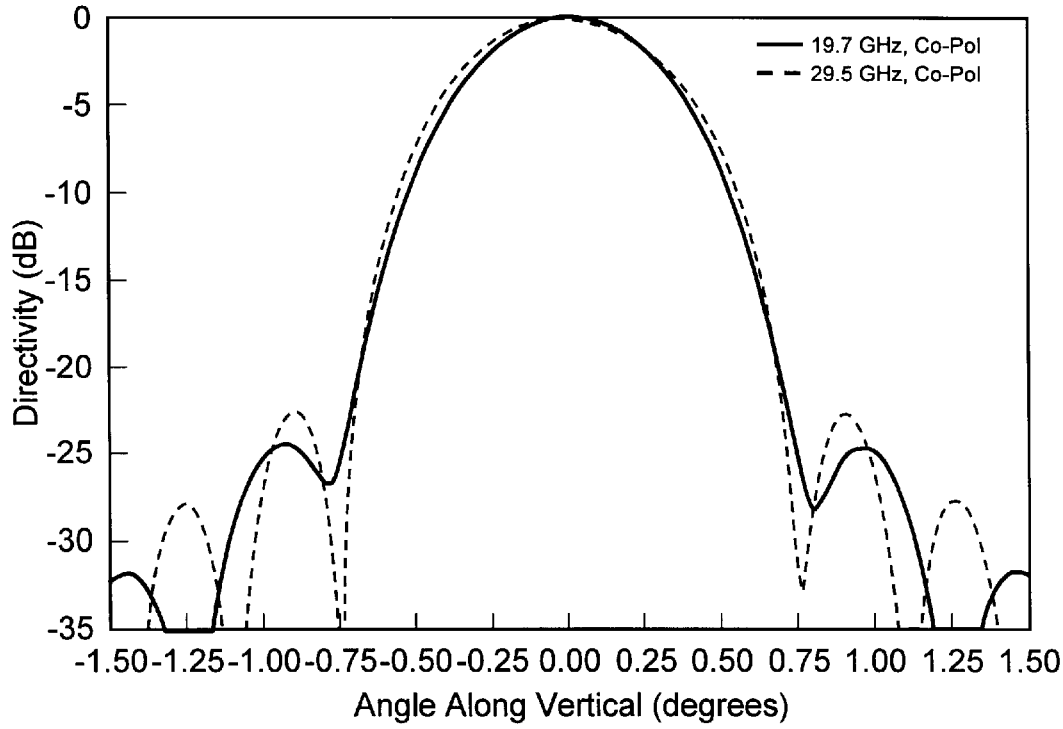

FIGS. 9(*a*) and 9(*b*) are also graphs with directivity in dB on the vertical axis and angle in degrees on the horizontal axis showing the secondary beams for the same beamwidths for 20 GHz and 30 GHz. FIG. 9(*a*) shows secondary cuts of a dual-band horn fed into an offset parabolic reflector for co-polarization at 19.7 GHz, co-polarization at 29.5 GHz, cross-polarization at 19.7 GHz and cross-polarization at 29.5 GHz. FIG. 9(*b*) shows normalized cuts for co-polarization at 19.7 GHz and co-polarization at 29.5 GHz, and demonstrates the equal beamwidths at both 19.7 GHz and 29.5 GHz.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An antenna system for receiving satellite uplink signals and transmitting satellite downlink signals having substantially equal beamwidths, said uplink and downlink signals having different frequency bands, said system comprising:

at least one beam forming network, said beam forming network providing signal isolation for the uplink and downlink signals;

at least one dual-band feed for receiving and directing the uplink signals to the beam forming network, and receiving and directing the downlink signals from the beam forming network; and at least one reflector for collecting and directing the uplink signals to the feed and collecting and directing the downlink signals from the feed, wherein the dual-band feed and the at least one reflector are positioned and configured to provide uplink signals and downlink signals having equal beamwidths.

2. The system according to claim 1 wherein the dual-band feed and the at least one reflector are positioned and configured so that the higher frequency uplink feed signal illuminates the reflector with a mainlobe and first sidelobes of the signal.

3. The system according to claim 2 wherein the lower frequency downlink feed signal illuminates the reflector with only a mainlobe of the signal.

4. The system according to claim 3 wherein the lower frequency downlink feed signal has an edge taper in the range of 0 dB to −20 dB.

5. The system according to claim 1 wherein the at least one feed is a feed horn including corrugations formed on an inner surface of the feed horn for providing the dual-band function.

6. The system according to claim 5 wherein the corrugations include two sets of alternating corrugations having different depths.

7. The system according to claim 1 wherein the at least one beam forming network includes a turnstile junction for separating and isolating the uplink and downlink signals.

8. The system according to claim 1 wherein the uplink signal is about 30 GHz and the downlink signal is about 20 GHz.

9. The system according to claim 1 wherein the ratio between the frequency band of the uplink and downlink signals is about 2/3.

10. The system according to claim 1 wherein the at least one reflector is a pair of reflectors.

11. The system according to claim 1 wherein the at least one beam forming network and the at least one dual-band feed includes an array of feed horns where each feed horn includes a beam forming network.

12. An antenna system for receiving satellite uplink signals and transmitting satellite downlink signals having substantially equal beamwidths, where the uplink and downlink signals have different frequency bands, said system comprising:

an array of dual-band feed horns, each feed horn receiving the uplink signals and transmitting the downlink signals;

a plurality of beam forming networks, each feed horn being coupled to a separate beam forming network, each beam forming network providing signal isolation for the uplink and downlink signals; and at least one reflector for collecting and directing the uplink signals to the array of feed horns and collecting and directing the downlink signals from the array of feed horns, wherein the array of dual-band feed horns and the at least one reflector are positioned and configured to provide uplink signals and downlink signals having equal beamwidths where the higher frequency uplink feed signal illuminates the at least one reflector with a mainlobe and first sidelobes of the signal and the lower frequency downlink feed signal illuminates the reflector with only a mainlobe of the signal.

13. The system according to claim 12 wherein each feed horn includes corrugations formed on an inner surface of the feed horn for providing the dual-band function.

14. The system according to claim 12 wherein the corrugations include two sets of alternating corrugations having different depths.

15. The system according to claim 12 wherein the at least one beam forming network includes a turnstile junction for separating and isolating the uplink and downlink signals.

16. The system according to claim 12 wherein the uplink signal is about 30 GHz and the downlink signal is about 20 GHz.

17. The system according to claim 12 wherein the ratio between frequency band of the uplink and downlink signals is about 2/3.

18. The system according to claim 12 wherein the at least one reflector is a pair of reflectors.

19. The system according to claim 12 wherein the lower frequency uplink or downlink signal has an edge taper in the range of −9 dB to −13 dB.

20. A method of providing equal beamwidth satellite uplink signals and downlink signals, said uplink and downlink signals having different frequency bands, said method comprising the steps of:

configuring and optimizing at least one dual-band feed horn for both the frequency bands of both the uplink and downlink signals;

separating and isolating the uplink and downlink signals in a beam forming network; and positioning at least one reflector relative to the at least one feed horn so that the higher frequency uplink feed signal illuminates the reflector with a mainlobe and first sidelobes of the signal and the lower frequency downlink feed signal only illuminates the reflector with a mainlobe of the signal so as to provide the equal antenna beamwidths.

21. The method according to claim 20 wherein the step of positioning at least one reflector includes positioning the reflector so that the lower frequency downlink feed signal has a −9 dB to −13 dB edge taper.

22. The method according to claim 20 wherein the step of configuring a feed horn includes providing two sets of alternating corrugations of different depths along an inside surface of the feed horn to provide the dual-band function.

* * * * *